United States Patent [19]

White

[11] 4,369,103

[45] Jan. 18, 1983

[54] SOLID POLYMER ELECTROLYTE CELL

[75] Inventor: Preston S. White, Corpus Christi, Tex.

[73] Assignee: PPG Industries, Inc., Pittsburgh, Pa.

[21] Appl. No.: 293,021

[22] Filed: Aug. 14, 1981

Related U.S. Application Data

[60] Division of Ser. No. 120,247, Feb. 11, 1980, abandoned, and a continuation-in-part of Ser. No. 105,055, Dec. 19, 1979, abandoned.

[51] Int. Cl.[3] ..... C25B 9/00; C25B 11/04; C25B 13/04

[52] U.S. Cl. ..... 204/252; 204/282; 204/296

[58] Field of Search ..... 204/252, 253–258, 204/263–266, 282, 291, 296

[56] References Cited

U.S. PATENT DOCUMENTS

| | | | |
|---|---|---|---|
| 3,134,697 | 5/1964 | Niedrach | 136/86 |
| 3,356,538 | 12/1967 | Miekka et al. | 136/120 |
| 3,385,780 | 5/1968 | Feng | 204/291 X |
| 3,423,228 | 1/1969 | Oster et al. | 117/47 |
| 3,461,044 | 8/1969 | Lyons, Jr. et al. | 204/3 |
| 4,065,366 | 12/1977 | Oda et al. | 204/98 |
| 4,191,618 | 3/1980 | Coker et al. | 204/282 X |
| 4,210,501 | 7/1980 | Dempsey et al. | 204/129 |
| 4,248,680 | 2/1981 | Carlin et al. | 204/292 X |
| 4,253,922 | 3/1981 | Welch | 204/282 X |
| 4,287,032 | 9/1981 | Pellegri | 204/128 |

*Primary Examiner*—Donald R. Valentine
*Attorney, Agent, or Firm*—Richard M. Goldman

[57] ABSTRACT

Disclosed is method of preparing a solid polymer electrolyte by depositing catalyst particles in hydrophilic, thermoplastic ion exchange material on the solid polymer electrolyte permionic membrane or a current collector-catalyst carrier. Also disclosed is the solid polymer electrolyte electrolytic cell prepared thereby.

1 Claim, No Drawings

SOLID POLYMER ELECTROLYTE CELL

CROSS REFERENCE TO RELATED APPLICATION

This is a division of application Ser. No. 120,247, filed Feb. 11, 1980, now abandoned, and a continuation-in-part of my commonly assigned, copending U.S. application Ser. No. 105,055, mailed Dec. 17, 1979, filed Dec. 19, 1979, now abandoned, for Solid Polymer Electrolyte and Method of Preparing Same.

DESCRIPTION OF THE INVENTION

Solid polymer electrolyte chlor-alkali cells, including zero gap permionic membrane cells that function as solid polymer electrolyte cells, have a cation selective permionic membrane separating the anolyte liquor from the catholyte liquor. In a zero gap permionic membrane cell either the anodic electrocatalyst is in contact with the anolyte facing surface of the permionic membrane, or the cathodic electrocatalyst is in contact with the catholyte facing surface of the permionic membrane. In a solid polymer electrolyte cell the anodic electrocatalyst is in contact with the anolyte facing surface of the permionic membrane and the cathodic electrocatalyst is in contact with the catholyte facing surface of the permionic membrane. Solid polymer electrolyte electrolytic cells are described generally in Belgian Pat. Nos. 872,632; 876,633; and 872,634, while zero gap solid polymer electrolyte electrolytic cells are described in the commonly assigned copending application of Donald W. DuBois et al filed Sept. 19, 1979, Ser. No. 076,898, now U.S. Pat. No. 4,342,629 for Solid Polymer Electrolyte Chlor-Alkali Process and Electrolytic Cell.

As described in the aforementioned Belgian patents and U.S. patent application, the electrocatalyst is typically embedded in and surrounded by a hydrophobic material, e.g. sintered polytetrafluoroethylene, fluorinated ethylene-propylene, or perfluoroalkoxy materials. As there described, the catalyst is in the form of particles embedded in the hydrophobic material. As further described in the aforementioned Belgian Patents, there is substantially no deformation of the permionic membrane during the process of adhering the catalyst particles thereto, the sulfonyl type membranes disclosed therein having a softening temperature near the thermal decomposition temperature thereof.

It has now been found that a particularly advantageous solid polymer electrolyte may be provided wherein at least one member of the electrode pair has its active catalyst members, i.e. catalytic particles, wire, mesh, screen, or the like, embedded in, bearing upon, or partially surrounded by a thermoplastic deformate of a hydrophilic, electrolyte resistant material. Suitable hydrophilic, electrolyte resistant materials include halogenated hydrocarbon polymers characterized by the presence of acid, ester, or alkali metal salt groups. According to a particularly perferred exemplification of this invention, the hydrophilic polymer is initially a thermally deformable, thermoplastic form of the permionic membrane or of a hydrophilic, thermoplastic resin compatible with the permionic membrane, and the catalyst particles are embedded in the resin while the resin is thermoplastic, whereby the particles are thereafter surrounded by a deformate of the resin. That is, the resin may be an acid, e.g., a carboxylic acid, or a lower alkyl ester thereof, e.g., a lower alkyl ester of a carboxylic acid.

By a thermoplastic deformate of the resin is meant a portion, e.g., an area, surface, film, layer, or volume of the resin that was deformed, e.g., by the application of heat or compression or both, while in a thermoplastic form, e.g., a carboxylic acid, an alkyl ester of a carboxylic acid, or an acid chloride of a sulfonic acid or carboxylic acid, as will be described more fully hereinafter, even though the subsequent state of the resin, e.g., after deposition of the catalyst particles and subsequent hydrolysis, may be rigid, brittle, or infusible, as a sodium or potassium salt thereof.

The electrocatalyst-hydrophilic resin material may be present as a laminate of electrocatalyst particles and hydrophilic resin film on the surface of the permionic membrane. Alternatively, the electrocatalyst-hydrophilic resin material may be present as a laminate of electrocatalyst particles and hydrophilic resin particles on the surface of the permionic membrane. Alternatively the electrocatalyst may be present as particles of catalyst in and on a thermoplastic deformate of the permionic membrane resin material. According to a still further exemplification, the electrocatalyst and the hydrophilic resin may be present as a deposit on a wire, mesh, or screen substrate maintained in contact with the solid polymer electrolyte permionic membrane, i.e. as an electrode of a zero gap solid polymer electrolyte electrolytic cell.

The solid polymer electrolytes herein contemplated may be prepared by providing a composition of a thermoplastic, hydrophilic, electrolyte resistant resin and the electrocatalyst material. According to a preferred exemplification the composition is kept in contact with the permionic membrane above the glass transition temperature of the thermoplastic, hydrophilic, electrolyte resistant material. This is to cause the composition of the resin and the electrocatalyst to form an adherent deposit, film, surface, or layer on the surface of the permionic membrane.

According to an alternative exemplification utilized in a zero gap solid polymer electrolyte cell the composition of hydrophilic resin and electrocatalyst is kept in contact with an open mesh, screen, or sheet-like metallic current carrier or substrate whereby to provide an electrode having electrocatalyst particles and a hydrophilic resin adhering thereto.

In the practice of the above contemplated exemplifications, the hydrophilic, electrolyte resistant resin may be in the form of particles, spheres, comminutes, pulverizates, or the like, as from, e.g. crushing, grinding, or pulverizing an extrudate, film, sheets, strands, or the like.

According to a further exemplification of the method herein contemplated, the permionic membrane may be a carboxylic acid or a low alkyl ester thereof, or an acid chloride, e.g., a carboxylic acid chloride or a sulfonic acid chloride, and may be rendered thermoplastic whereby to deposit particulate catalyst therein.

DETAILED DESCRIPTION OF THE INVENTION

Solid polymer electrolyte chlor alkali cells have a solid polymer electrolyte dividing the anolyte from the catholyte. The solid polymer electrolyte includes a permionic membrane with either cathodic electrocatalyst in contact with the catholyte facing surface thereof, or anodic electrocatalyst in contact with the anolyte facing surface, or both cathodic electrocatalyst in contact with the catholyte facing surface and anodic electrocatalyst in contact with the anolyte facing surface. The electrocatalyst in contact with the permionic membrane is adherent to either the permionic membrane or to a catalyst carrier or current carrier or combination catalyst carrier and current carrier that is maintained in contact with the permionic membrane, i.e., as in a zero gap solid polymer electrolyte cell or hybrid cell. When the electrocatalyst is spaced from the permionic membrane, the electrocatalyst adheres to a catalyst carrier or current carrier or combination catalyst carrier and current carrier, as in a hybrid cell.

As herein contemplated, the electrocatalyst is present and in contact with a hydrophilic material, e.g. a hydrophilic layer, sheet, film, laminate, or a deformate of hydrophilic comminutes, particles, strands, extrudates, or the like, or a deformate of a hydrophilic layer, sheet, film, or laminate. The hydrophilic material is deformed, e.g. a thermally and compressively deformed product of a thermoplastic form of the hydrophilic material.

The contemplated structure of hydrophilic material and electrocatalyst is a thin, porous, gas permeable, and electrolyte wettable form or mass present on the permionic membrane or catalyst carrier as a film, sheet, laminate, layer, or the like having the aforementioned properties.

As herein contemplated the loading of hydrophilic material, basis total hydrophilic material and electrocatalyst in the catalyst film, is from about 5 to about 75 weight percent, preferably from about 10 to about 50 weight percent, and in a particularly preferred exemplification from about 15 to about 35 weight percent. In this way a catalyst loading of from about 0.1 to about 10.0 milligrams of catalyst per square centimeter of permionic membrane, and a film thickness of about 0.5 to 15 mils is provided. Especially preferred is a catalyst loading of about 0.5 to 5 milligrams of catalyst per square centimeter of permionic membrane, and a film thickness of about 2 to 5 mils, although thicker or thinner film thicknesses may be utilized without deleterious effect.

In one exemplification the hydrophilic resin and the electrocatalyst particles are applied to a substrate, e.g. a permionic membrane or a catalyst carrier, under conditions where the resin is thermoplastic so as to deform, and cause the electrocatalyst particles to adhere to the hydrophilic resin-electrocatalyst mass, which is in turn adherent to the substrate.

In an alternative exemplification the electrocatalyst particles are applied directly to a substrate, e.g., a permionic membrane, that is in the thermoplastic form, e.g., a carboxylic acid, a low alkyl ester of a carboxylic acid, or an acid chloride of a carboxylic acid or of a sulfonic acid, under conditions of temperature or pressure where the substrate is thermoplastic so as to deform and cause the electrocatalyst particles to adhere to the substrate.

While the hydrophilic resin is spoken of as being a thermoplastic resin, or a deformate of a thermoplastic resin, it is to be understood that the characterization thereof as a thermoplastic resin refers to its state at the time of fabrication of the solid polymer electrolyte or the catalyst carrier, and the resin may subsequently lose its thermoplastic character, e.g., by hydrolysis to the alkali metal salt.

The resins herein contemplated, i.e., cation selective ion exchange resins, have thermoplastic properties that depend upon the substituents bonded to the active ion exchange groups, upon the presence of ether linkages, and upon the substantial absence of cross-linking. For example, resins having equal degrees of cross-linking and equal concentrations of ether linkages are thermoplastic in the ester form, thermoplastic, but less so, in the acid form, and substantially less thermoplastic in the alkali metal salt form. Additionally, the higher the concentration of ether linkages, the more thermoplastic and deformable the resin is.

As herein contemplated the hydrophilic resin is present in the ester or acid form, and preferably in the ester form for a carboxylic acid, and in the acid chloride form for either a carboxylic acid or a sulfonic acid, during formation of the solid polymer electrolyte. Additionally, the resin should have a low content of crosslinking agents, i.e. lower than or equal to that of the resin of the underlying permionic membrane, and a high content of ether linkages, i.e. higher than or equal to that of tha underlying permionic membrane.

Where the hydrophilic resin is in the alkali metal carboxylate salt form, it can be converted to the hydrogen carboxylic acid, the carboxylic acid anhydride, or, in a preferred exemplification, to the lower alkyl alcohol ester.

For example, the alkali metal carboxylate salt may be converted to the carboxylic acid by contacting the salt with an acid, e.g. an aqueous acid solution, in the presence of a suitable polar solvent. Suitable acids include inorganic acids such as hydrochloric acid, sulfuric acid, nitric acid, or phosphoric acid, inter alia, and organic acids such as acetic acid, haloacetic acids including trihaloacetic acids, e.g. trichloroacetic acid and trifluoracetic acid, and propionic acid, inter alia. The acid is preferably added as an aqueous solution, e.g. a 0.5 weight percent to 90 weight percent aqueous acid solution, and preferably as a 1.0 to 30 weight percent aqueous acid solution.

Suitable solvents include water, and polar organic solvents such as methanol, ethanol, ethylene glycol, dimethyl sulfoxide, acetic acid, phenol, and the like. The polar organic solvent, when used, is present at a concentration of 5 to 90 weight percent. The reaction is carried out of a temperature of 10° C. to 120° C. for about 30 minutes to 24 hours.

Thereafter the carboxylic acid groups can be converted to alkyl ester groups by reaction with an alcohol. Desirable alcohols are the lower alkyl alcohols, i.e. the $C_1$ to $C_5$ alcohols, such as methanol, ethanol, propanol, butanol, pentanol, and isomers thereof.

Alternatively, the carboxylic acid groups can be converted to acid halide groups or acid anhydride groups, with subsequent conversion of the acid halide groups or acid anhydride groups to the esters.

When the ester is formed from carboxylic acid halide groups, the acid halide may be formed by reacting the carboxylic acid with phosphorus trichloride, phosphorus oxychloride, thionyl chloride, or the like, and thereafter the acid halide reacted with an alcohol.

When the ester is formed from carboxylic acid anhydride groups, the carboxylic acid anhydride may be formed by reacting the carboxylic acid group with an acid anhydride, e.g. acetic acid anhydride, and thereafter reacting the acid anhydride formed thereby with an alcohol.

When the permionic membrane is a sulfonic acid membrane, e.g., either a sulfonic acid or a derivative thereof, as an alkali metal salt, it must be converted to the sulfonyl acid halide, e.g., the sulfonyl acid chloride, to render it thermoplastic. The conversion to the sulfonyl acid halide may be carried out by reaction with $SOCl_2$ or $PCl_5$. For example, the sulfonic acid membrane or the metal salt thereof may be contacted with $PCl_5$ vapor, or with $PCl_5$ solution, e.g., $PCl_5$ in $POCl_3$ or in $POCl_3$ and an organic solvent, such as halohydrocarbon. Suitable halohydrocarbon solvents include trichlorethylene; perchlorethylene; 1,1,2-trichloro ethane; 1,1,2,2-tetrachloro ethane; 1,2-difluoro-1,1,2,2 tetrachloro ethane. The ratio of $PCl_5$ to either $POCl_3$ or to $POCl_3$ plus halohydrocarbon solvent is from about 0.01 to about 1.6, and preferably from about 0.25 to about 1.0. Generally the time required for conversion of the sulfonyl acid or salt to the acid chloride is at least about 8 hours at the atmospheric boiling point of the $PCl_5$ solution.

Alternatively, the sulfonic acid membrane or alkali metal salt thereof is contacted with $SOCl_2$ to form the acid chloride. This is carried by refluxing with $SOCl_2$ for a time sufficient to form the acid chloride, e.g., at least about 8 hours, and preferably about 16 to 48 hours.

The application of the electrocatalyst particles to the thermoplastic, hydrophilic resin and the application of the hydrophilic resin and electrocatalyst to the substrate is carried out at elevated temperature and pressure whereby to render the resin flowable, deformable, tacky, or partially molten, and thereafter deform the resin, with the particles therein, to cause the deformate and catalyst particles to adhere to the substrate. The temperature range herein contemplated is high enough to give the hydrophilic resin a volumetric flow rate above about 0.1 cubic millimeter per second, but below the thermal decomposition temperature of the resin. The temperature necessary to provide the above recited volumetric flow rate is a function of the concentration of ether linkages in the resin, the substituents in the resin, the extent of cross linking, and the degree of polymerization, and can be found by routine testing. As a practical matter this temperature will be at least about 120° C., and generally from about 130° C. to about 150° C.

The pressure necessary for deformation of the resin and deposition of the electrocatalyst particles therein is at least about 1 kilogram per square centimeter, and preferably from about 1 kilogram per square centimeter to about 300 kilograms per square centimeter, although higher pressures may be used.

The pressure and temperature are maintained until the electrocatalyst particles are set into the resin, and the mass of resin and electrocatalyst is adherent to the substrate, e.g., from about 1 minute to about 5 hours.

Specific combinations and permutations of time, temperature, and pressure within the above recited ranges herein contemplated are dependent upon the resin, and the size of the electrocatalyst particles, and may be determined by routine testing.

The hydrophilic, thermoplastic resin used to effect adherence of the electrocatalyst to the substrate and provide a hydrophilic bed therefor may, as a matter of convenience, be the same halogenated hydrocarbon ion exchange material as the underlying permionic membrane. When the hydrophilic, thermoplastic resin differs from the underlying permionic membrane, the thermoplastic resin may have a lower glass transition temperature than the underlying permionic membrane for a given volumetric flow rate, as described above. Alternatively, the hydrophilic resin and the underlying permionic membrane may have similar halocarbon backbones, differing in either ion selective substituents, or physical properties, e.g. thermoplastic properties, or both. However, the hydrophilic, thermoplastic resin herein contemplated is a polymeric, halogenated hydrocarbon, preferably a fluorinated hydrocarbon, having immobile, cation selective ion exchange groups on a halocarbon backbone.

The permionic membrane interposed between the anolyte and the catholyte is also a polymeric, halogenated hydrocarbon having immobile, cation selective ion exchange groups on a halocarbon backbone. The membrane may be from about 2 to about 10 mils thick, although thicker or thinner permionic membranes may be utilized. In this way a solid polymer electrolyte having a thickness of from about 3 to about 40 mils is provided. The permionic membrane may be a laminate of two or more membrane sheets. It may, additionally, have internal reinforcing fibers.

The permionic membrane, as well as the hydrophilic polymers, may be copolymers of (I) a fluorovinyl polyether having pendant ion exchange groups and having the formula:

$$\text{(I)}\quad CF_2{=}CF{-}O_a{-}[(CF_2)_b(CX'X'')_c(CFX')_d(CF_2{-}O{-}(X'X'')_e(CX''X'O{-}CF_2)_f]\text{-}A$$

where a is 0 or 1, b is 0 to 6, c is 0 to 6, d is 0 to 6, e is 0 to 6, f is 0 to 6; X, X', and X'' are —H, —Cl, —F, and $-(CF_2)_gCF_3$; g is 1 to 5; [ ] is a discretionary arrangement of the moieties therein; and A is the pendant ion exchange group as will be described hereinbelow. Preferably a is 1, and X, X', and X'' are —F and $(CF_2)_gCF_3$.

The fluorovinyl polyether may be copolymerized with a (II) fluorovinyl compound:

$$\text{(II)}\quad CF_2{=}CF{-}O_a{-}(CFX''_d){-}A$$

and a (III) perfluorinated olefin $$\text{(III)}\quad CF_2{=}CXX',$$

or (I) may be copolymerized with only a (III) perfluorinated olefin, or (I) may be copolymerized with only a (II) perfluorovinyl compound.

The ion exchange group is a cation selective group. It may be a sulfonic group, a phosphoric group, a phosphoric group, a carboxylic group, a precursor thereof, or a reaction product thereof, e.g. an ester thereof. Carboxylic groups, precursors thereof, and reactions products thereof are preferred. Thus, as herein contemplated, A is preferably chosen from the group consisting of:

—COOH,
—$COOR_1$,
—COOM,
—COF,
—COCl,
—CN,
—$CONR_2R_3$,
—$SO_3H$,
—$SO_3M$,
—$SO_2F$, and
—$SO_2Cl$ where $R_1$ is a $C_1$ to $C_{10}$ alkyl group, $R_2$ and $R_3$ are hydrogen or $C_1$ to $C_{10}$ alkyl groups, and M is an alkali metal or a quaternary ammonium group. According to a particularly preferred exemplification A is:

—COF,

—COCl,
—COOH,
—$COOR_1$
—$SO_2F$, or
—$SO_2Cl$ where $R_1$ is a $C_1$ to $C_5$ alkyl.

The permionic membrane herein contemplated has an ion exchange capacity of from about 0.5 to about 2.0 milliequivalents per gram of dry polymer, preferably from about 0.9 to about 1.8 milliequivalents per gram of dry polymer, and in a particularly preferred exemplification, from about 1.0 to about 1.6 milliequivalents per gram of dry polymer. The permionic membrane herein contemplated has a volumetric flow rate of 100 cubic millimeters per second at a temperature of 150 to 300 degrees Centigrade, and preferably at a temperature between 160 to 250 degrees Centigrade. The glass transition temperature of the permionic membrane polymer is below 70° C., and preferably below about 50° C.

The permionic membranes herein contemplated may be prepared by the methods described in U.S. Pat. No. 4,126,588, the disclosure of which is incorporated herein by reference.

While the hydrophilic hydrocarbon resin utilized in combination with the electrocatalyst is referred to as being formed of ion exchange material, it is to be understood that the resin may be more elastic and more thermoplastic than the ion-exchange material used in the fabrication of the permionic membrane. As herein contemplated the hydrophilic resin has a volumetric flow rate substantially equal to or higher than that of the permionic membrane, a temperature for a given volumetric flow rate that is lower than or equal to that of permionic membrane, and a glass transition temperature that is lower than or equal to that of the permionic membrane. The increased extrudability, formability, or deformability of the hydrophilic resin when such properties are present is such as to allow its deformation during fabrication of the solid polymer electrolyte, while allowing less deformation of the underlying permionic membrane. This may be accomplished by the addition of plasticizers, or by decreasing chain stiffness, or both. By decreased chain stiffness is meant the effect observed with short side chains having, for example, ether linkages, compared to longer side chains having fewer ether linkages. As herein contemplated the hydrophilic resin binding the catalyst particles to the permionic membrane or to the catalyst carrier has an ether linkage content at least equal to, and preferably greater than the ether linkage content of the permionic membrane. The ether linkage content of the hydrophilic resin may be enhanced by providing moieties therein having the formula (IV) $CF_2{=}CFOR_4$ in the polymer, where $R_4$ is $C_1$ to $C_5$ perfluoroalkyl radical. Preferably the hydrophilic resin is applied to the permionic membrane or to the catalyst carrier as an ester, e.g. as a methyl alcohol, ethyl alcohol, butyl alcohol, or propyl alcohol ester. Alternatively, it can be applied to the membrane or current carrier as the acid form or the acid halide form. However, the alkali metal salt form does not have sufficient volumetric melt flow to allow its use.

As herein contemplated both the underlying permionic membrane and the hydrophilic resin are copolymers which may have: (I) fluorovinyl ether acid moieties derived from:

$$CF_2{=}CF{-}O{-}[CF_2)_b(CX'X'')_c(CFX')(CF_2{-}O{-}CX'X'')_e(CX'X''{-}O{-}CF_2)_f]\text{-}A,$$

exemplified by:

$$CF_2{=}CFOCF_2CF(CF_3)OCF_3CF_2CF_2COOOCH_3,$$

$$CF_2{=}CFO(CF_2)_3O\underset{\underset{CF_3}{|}}{C}FCOOCH_3,$$

$$CF_2{=}CFO(CF_2)_4O\underset{\underset{CF_3}{|}}{C}FCOOCH_3,$$

$$CF_2{=}CFOCF_2\underset{\underset{CF_3}{|}}{C}FCF_2COOCH_3, \text{ and}$$

$$CF_2{=}CFOCF_2CF(CF_3)OCF(COOCH_3)CF_3, \text{ inter alia;}$$

(II) fluorovinyl moieties derived from:

$$CF_2{=}CF{-}(O)_a{-}(CFX')_d{-}A,$$

exemplified by:

$$CF_2{=}CF(CF_2)_{2\text{-}4}COOCH_3,$$

$$CF_2{=}CF(CF_2)_{2\text{-}4}COOCH_3$$

$$CF_2{=}CFO(CF_2)_{2\text{-}4}COOCH_3,$$

$$CF_2{=}CFO(CF_2)_{2\text{-}4}COOC_2H_5, \text{ and}$$

$$CF_2{=}CFO(CF_2)_{2\text{-}4}COOCH_3, \text{ inter alia;}$$

(III) fluorinated olefin moieties derived from:

$$CF_2{=}CXX'$$

as exemplified by tetrafluoroethylene, trichlorofluoroethylene, hexafluoropropylene, trifluoroethylene, vinylidene fluoride, and the like; and (IV) vinyl ethers derived from:

$$CF_2{=}CFOR_4;$$

with the ether linkage content of the hydrophilic resin being equal to or higher than the ether linkage content of the underlying permionic membrane.

While the above resins are illustrated as carboxylic acid esters, it is to be understood that sulfonyl halide resins, e.g., sulfonyl chloride resins, capable of thermoplastic behavior may also be used.

The hydrophilic, thermoplastic resin carrying the electrocatalyst may be distinct from the underlying permionic membrane. That is, it may not be a deformed surface of the underlying permionic membrane, but may be a laminate, or sheet, or film, or the like lying thereon, or bonded or otherwise adherent to the permionic membrane.

In one exemplification the hydrophilic resin and electrocatalyst particles are present on the permionic membrane as a thin, porous, gas permeable, electrolyte wettable, bonded mass. The hydrophilic resin and electrocatalyst form a film, layer, sheet, laminate, or surface that is in contact with the permionic membrane, and may be embedded therein or even bonded thereto.

In an alternative exemplification, the electrocatalyst particles are in and on a thermoplastic deformate of the permionic membrane, i.e., as where the permionic membrane is in a thermoplastic form during adhesion of the particles, and thereafter the membrane is hydrolyzed to an infusible alkali metal salt form.

In a further alternative exemplification the hydrophilic resin and electrocatalyst particles are bonded to a mesh, screen or perforated metal film, which serves as, e.g. a catalyst carrier and a current collector. The electrocatalytic particles and hydrophilic resin are present on the metal structure as a thin, porous, gas permeable, electrolyte wettable sheet, layer, film, web, or the like, which may either coat individual fibers or strands or bridge adjacent fibers and strands of the current collector or catalyst carrier. The fine mesh bears upon the permionic membrane.

According to a still further alternative exemplification, the electrolytic cell may be a hybrid electrolytic cell with one zero gap electrode as described above, and one electrode bonded to and embedded in the membrane.

Various electrocatalysts may advantageously be used. For example, the electrocatalysts may be graphite, fluorinated graphite, metals, and various metallic compounds.

The electrocatalyst particles are preferably fine mesh particles, e.g. particles smaller than minus 100 mesh. Especially preferred are particles smaller than 325 mesh, i.e., minus 325 mesh particles. Such fine particles, e.g. nickel particles finer than 325 mesh, may be pyrophoric and require processing in organic solvents, e.g. alcohols, ketones, ethers, and the like, or in water.

One particularly satisfactory group of anodic electrocatalysts are the oxides of the platinum group metals, especially oxides of enhanced surface area. Alternatively, the oxides of the platinum group metals may be present with oxides or oxycompounds of other metals. The other metal oxides may be oxides of titanium, tungsten, tantalum, niobium, vanadium, and the like. The oxide of the second metal may be present as conductive powders or particles of low chlorine overvoltage, or as mixed crystals, intermetallic oxides, intermetallic oxycompounds, or the like, with the oxides of the platinum group metal.

One particularly desirable group of electrocatalysts that may be used with the hydrophilic resins as herein contemplated are the thermal decomposition products of halides of platinum group metals, e.g. ruthenium, iridium, and ruthenium-iridium alloys. These catalysts are prepared by thermal decomposition of the halides under oxidizing conditions, followed by comminution, washing, reduction, e.g. with hydrogen or carbon monoxide, and further comminution, and washing.

The cathodic electrocatalysts are preferably porous particles of transition metals, e.g. iron, cobalt, nickel, and the like. Additionally, other materials may be present therewith, e.g. molybdenum with nickel to stabilize the hydrogen overvoltage characteristics of the nickel. The porous, cathodic electrocatalytic particles may be prepared by conventional means.

As described hereinabove the catalysts are typically applied by forming a composition of the thermoplastic resin and catalyst particles. The resin may be in the form of a comminute, an extrudate, or the like. Thereafter the composition is rendered thermoplastic and applied to the substrate, e.g. the permionic membrane or the catalyst carrier.

According to one particularly preferred exemplification a solid polymer electrolyte is prepared having an anodic surface of a perfluorinated carboxylic acid ion exchange resin with graphite particles therein, a cathodic surface of a perfluorinated carboxylic acid ion exchange resin with porous nickel particles therein, and a perfluorinated, cation selective, permionic membrane therebetween.

According to the exemplification herein contemplated a composition is prepared containing 3 parts of graphite given to one part of perfluorinated carboxylic acid given. This is spread on a 10 mil thick permionic membrane, and heated to 210° C. at a pressure of about 20 kilograms per square centimeter for ten minutes. A composition of 10 parts of a mixture of 60 weight percent iron fines and 40 weight percent nickel fines is mixed with 1 part of perfluorinated carboxylic acid ion exchange resin fines, and applied to the opposite surface of the permionic membrane, by heating to 200° C. at a pressure of 200 kilograms per square centimeter for ten minutes.

The solid polymer electrolyte prepared thereby is installed in an electrolytic cell between a titanium mesh anodic current collector and a copper mesh cathodic current collector. Electrolysis is commenced with an aqueous sodium chloride anolyte liquor and an aqueous sodium hydroxide catholyte liquor, whereby to evolve chlorine at the anodic surface of the solid polymer electrolyte, hydrogen at the cathodic surface of the solid polymer electrolyte, and hydroxyl ion in the catholyte liquor.

According to an alternative exemplification, a solid polymer electrolyte is prepared having a perfluorinated carboxylic acid ion exchange membrane interposed between and in contact with an anodic catalyst carrier on one surface thereof and a cathodic catalyst carrier on the opposite surface thereof.

As herein contemplated each of the cathode carriers has a thin, porous, gas permeable, electrolyte wettable film, sheet, layer or coating on the individual threads, strands or filaments of the catalyst carrier with, possibly, some bridging therebetween.

According to the alternative exemplification herein contemplated, a composition is prepared containing 5 parts of fines of a rutile-form crystalline material containing oxides of ruthenium and titanium and one part of fines of a perfluorinated, carboxylic acid, ion exchange material. This is applied to a titanium screen catalyst carrier having a mesh of 10 filaments per inch by 10 filaments per inch, each filament being 0.03 inch diameter, having an open area of approximately 50 percent. The composition is pressed into the mesh at a pressure of about 175 kilograms per square centimeter and a temperature of 200° C. for 5 minutes.

According to the alternative exemplification herein contemplated, a composition is prepared containing five parts NaOH-etched grade 316 stainless steel fines and one part of the methyl alcohol ester of a perfluorinated carboxylic acid ion exchange resin material. This is applied to a stainless steel wire mesh screen having a mesh of 8 filaments per inch by 8 filaments per inch, each filament being 0.03 inch diameter, and having 65 percent open area. The wire mesh screen and composition are heated to about 200° C., at a pressure of 150 kilograms per square centimeter for 20 minutes whereby to provide a cathode.

The zero gap permionic membrane cell that functions as a solid polymer electrolyte electrolytic cell is assembled by compressing a permionic membrane between anode and cathode units prepared as described above. Thereafter electrolysis may be commenced with a sodium chloride brine anolyte and an aqueous sodium hydroxide catholyte.

The following examples are illustrative.

EXAMPLE I

A solid polymer electrolyte-anode unit was prepared by codepositing an electrocatalyst and a thermoplastic perfluorinated, carboxylic acid ion exchange material onto a perfluorinated, carboxylic acid permionic membrane.

The anode was prepared by mixing 4.5 grams of minus 325 mesh graphite powder as an anodic electrocatalyst and 1.5 grams of ground perfluorinated carboxylic acid ion exchange material, in the acid form.

This was applied to a 10 mil thick perfluorinated carboxylic acid permionic membrane and heated at 200° C. and 55 kilograms per square centimeter for ten minutes.

The current carrier was titanium mesh coated with a platinum-tin-ruthenium alloy, and bearing against the solid polymer electrolyte.

The anodic chlorine evolution potential was measured in saturated brine, at pH=2. The results are given in Table I below:

TABLE I

| Anodic chlorine evolution potential versus Ag/AgCl | Current density Amperes per square Foot |
|---|---|
| 1.17 | 200 |
| 1.22 | 400 |
| 1.24 | 600 |
| 1.29 | 800 |
| 1.32 | 1000 |

EXAMPLE II

A solid polymer electrolyte-anode unit was prepared by codepositing an electrocatalyst and a thermoplastic perfluorinated, carboxylic acid ion exchange material onto a titanium mesh catalyst carrier.

The anode was prepared by mixing 10 grams of minus 325 mesh graphite powder impregnated with palladium-tin-ruthenium alloy as an anodic electrocatalyst and 20 grams of ground perfluorinated carboxylic acid ion exchange material, in the acid form.

This was applied to a titanium mesh catalyst carrier having a mesh size of 80 per inch and a gauge of 0.005 inch. The coated titanium mesh was heated at 210° C. and 170 kilograms per square centimeter pressure for ten minutes.

The anodic chlorine evolution potential was measured in saturated brine, at pH=2. The results are given in Table II below:

TABLE II

| Anodic chlorine evolution potential versus Ag/AgCl | Current density Amperes per square Foot |
|---|---|
| 1.16 | 700 |
| 1.17 | 400 |
| 1.19 | 600 |
| 1.24 | 800 |
| 1.30 | 1000 |

EXAMPLE III

A solid polymer electrolyte-cathode unit was prepared by codepositing an electrocatalyst and a thermoplastic, perfluorinated, carboxylic acid ion exchange material onto a metallic catalyst carrier.

The cathode was prepared by mixing 3.0 grams of minus 325 mesh grade 316 stainless steel in water as a cathodic electrocatalyst, and 2.0 grams of ground, perfluorinated, thermoplastic, carboxylic acid ion exchange material, in the acid form.

This was applied to an 80 mesh, 0.005 inch gauge copper catalyst carrier, bearing upon a 10 mil thick perfluorinated carboxylic acid permionic membrane, and heated at 200° C. and 125 kilograms per square centimeter pressure for 10 minutes.

The resulting solid polymer electrolyte-cathode unit was then tested as a cathode in 25 weight percent aqueous NaOH. The cathodic potential, versus an Ag/AgCl reference electrode, was 1.53 volts at 200 Amperes per square foot.

EXAMPLE IV

A solid polymer electrolyte-cathode unit was prepared by codepositing an electrocatalyst and a thermoplastic, perfluorinated, carboxylic acid ion exchange material onto a metallic catalyst carrier.

The cathode was prepared by mixing 3.0 grams of minus 325 mesh mixed metal powder containing 58 weight percent iron powder and 42 weight percent nickel powder as a cathodic electrocatalyst, and 0.3 grams of ground, perfluorinated, thermoplastic, carboxylic acid ion exchange material, in the acid form.

This was applied to an 80 mesh, 0.005 inch gauge copper catalyst carrier, bearing upon a 10 mil thick, fluorinated, carboxylic acid permionic membrane and heated at 200° C. and 125 kilograms per square centimeter pressure for 10 minutes.

The resulting solid polymer electrolyte-cathode unit was then tested as a cathode in 25 weight percent aqueous NaOH. The cathodic potential, versus an Ag/AgCl reference electrode, was 1.41 volts at 200 Amperes per square foot.

EXAMPLE V

A solid polymer electrolyte-cathode unit was prepared by codepositing an electrocatalyst and a thermoplastic, perfluorinated, carboxylic acid ion exchange material onto a metallic catalyst carrier.

The cathode was prepared by mixing 3.0 grams of powder prepared by etching minus 325 mesh 316 stainless steel powder in 70 weight percent aqueous NaOH for 116 hours at 150° C., with subsequent washing in dilute HCl, as a cathodic electrocatalyst, and 0.3 grams of ground, perfluorinated, thermoplastic, carboxylic acid ion exchange material, in the acid form.

This was applied to an 80 mesh, 0.005 inch gauge copper catalyst carrier, and heated at 200° C. and 125 kilograms per square centimeter for 10 minutes.

The resulting solid polymer electrolyte-cathode unit was then tested as a cathode in 25 weight percent aqueous NaOH. The cathodic potential, versus an Ag/AgCl reference electrode, was 1.34 volts at 200 Amperes per square foot.

While the invention has been described with respect to certain preferred exemplifications, embodiments, and illustrative examples, it is to be understood that the invention is not to be limited thereby, and that alternative exemplifications and embodiments are encompassed within the contemplated scope of the invention, the invention being limited solely by the claims appended hereto.

I claim:

1. In an electrolytic cell divided into two electrolyte compartments by a permionic membrane, said electrolytic cell having an electrode pair of anodic electrocatalyst in contact with one surface of the permionic membrane and cathodic electrocatalyst in contact with the opposite surface thereof, the improvement wherein at least one member of said electrode pair comprises electrocatalyst particles adherent to the permionic membrane, said electrocatalyst particles being rendered adherent to the permionic membrane when a surface of the permionic membrane is in a thermoplastic form chosen from the group consisting of low alkyl esters of carboxylic acid resins, acid halides of carboxylic acid resins, and acid halides of sulfonic acid resins.

* * * * *